US006682357B2

(12) United States Patent
Sikora et al.

(10) Patent No.: US 6,682,357 B2
(45) Date of Patent: Jan. 27, 2004

(54) ELECTRICAL TERMINAL CONNECTOR

(75) Inventors: Ken Sikora, Fort Wayne, IN (US); Walt Strasser, Grabill, IN (US)

(73) Assignee: Dekko Stamping, Fort Wayne, IN (US)

( * ) Notice: Subject to any disclaimer, the term of this patent is extended or adjusted under 35 U.S.C. 154(b) by 0 days.

(21) Appl. No.: 10/103,622

(22) Filed: Mar. 21, 2002

(65) Prior Publication Data

US 2003/0181081 A1 Sep. 25, 2003

(51) Int. Cl.[7] ..... H01R 13/49
(52) U.S. Cl. ..... 439/125
(58) Field of Search ..... 439/125–129, 439/839, 843–848

(56) References Cited

U.S. PATENT DOCUMENTS

| | | | | |
|---|---|---|---|---|
| 2,792,558 A | | 5/1957 | Woofter | 339/26 |
| 4,758,189 A | | 7/1988 | Draxler | 439/848 |
| 5,340,323 A | | 8/1994 | Imanishi et al. | 439/125 |
| 5,348,486 A | | 9/1994 | Tura, Jr. et al. | 439/125 |
| 5,810,610 A | | 9/1998 | Kobayashi et al. | 439/125 |
| 5,885,117 A | | 3/1999 | Cvasa | 439/848 |
| 5,951,308 A | | 9/1999 | Rea | 439/125 |
| 6,048,217 A | | 4/2000 | Kobayashi | 439/125 |
| 6,280,210 B1 | | 8/2001 | Sikora et al. | 439/127 |
| 6,386,893 B2 | * | 5/2002 | Reum et al. | 439/125 |

* cited by examiner

*Primary Examiner*—Renee Luebke
*Assistant Examiner*—Ann McCamey
(74) *Attorney, Agent, or Firm*—Taylor & Aust, P.C.

(57) ABSTRACT

An electrical connector for connecting a conductor to a terminal post advantageous for connecting to the post of a spark plug. The connector includes a cylindrical shell for surrounding the post and an inwardly extending dimple. The dimple has a ramp-like forward surface.

15 Claims, 1 Drawing Sheet

ELECTRICAL TERMINAL CONNECTOR

BACKGROUND OF THE INVENTION

1. Field of the Invention

The present invention relates to electrical connectors, and, more particularly, to a connector for selectively connecting an insulated conductor to a conductive terminal post, for example, of the type commonly found in automotive ignition systems for connecting a wire to a spark plug.

2. Description of the Related Art

Automotive ignitions systems frequently have a cable or similar insulated conductor connecting a distributor terminal to a corresponding spark plug. The spark plug characteristically has a central terminal post to which one end of the cable connects. The plug body is grounded to the engine head or block. The spark plug end of the cable may have an electrical connector or terminal that is crimped to the cable contacting the cable conductor, and have a free end for selectively gripping the central terminal post of the spark plug. The distributor end of the cable may also have an electrical connector crimped to the cable contacting the cable conductor, and a free end for selectively gripping a distributor post. The connector may be of a straight variety where the cable extends away from the terminal post generally in alignment with the terminal axis, or may be of an orthogonal variety where the cable extends away from the post generally perpendicular to the axis of the post. The distributor may have a terminal post to which the distributor end of the cable connects, or may have a cavity into which a conductive sleeve, that is crimped to the cable end and contacts the conductor, may be inserted. Spark plug connectors are frequently, but not necessarily, of the straight variety, and distributor terminal connectors are typically, but not always, of the orthogonal variety.

It is important that the connector be relatively easily removed from the terminal post for engine maintenance, yet securely grip the terminal post both to achieve good electrical contact and to prevent inadvertently disconnecting from the terminal post. Forming the connector from thinner material facilitates manufacture and reduces material costs, however material strength and resilience are reduced, and there is a correlative reduction in the radially inward forces which serve to retain the connector on the post.

It is known to provide the end of the connector that is to be secured to the spark plug terminal post as a cylindrical body with a longitudinal slit, with one or more holes or openings in the cylindrical body, on opposite sides of the longitudinal slit. The longitudinal slit allows the cylinder walls to push outwardly as the connector is pushed onto the spark plug terminal post. A band surrounds part of the cylindrical body, spanning the longitudinal slit, and has hemispherical dimples that project through the openings of the cylindrical body to engage the spark plug terminal post. While connectors of this type have worked to some degree of satisfaction, the force required to insert the spark plug terminal post into the connector is relatively high. The resistance encountered can falsely imply that the terminal is fully inserted, leading to a faulty connection between the conductor and the spark plug.

What is needed in the art is a spark plug terminal connector for automobile ignition systems that requires reduced insertion force for connecting the terminal to a spark plug terminal post, without substantial reduction in the retention force of the terminal on the spark plug terminal post.

SUMMARY OF THE INVENTION

The present invention provides a connector requiring less force than previous connector designs for engaging a terminal post, through the use of ramp-like surface for sliding the connector onto the terminal post.

The invention comprises, in one form thereof, an electrical connector for connecting a conductor to a generally cylindrical conductive terminal post. A first connector portion has a cylindrical shell of about the same axial length as the terminal post. The shell has an open forward end and an inner surface with an inner circumference to completely encircle the terminal post. The shell has at least one rectangular opening therein. A band encircles at least a portion of the shell, and includes at least one inwardly extending dimple shaped for receipt in the opening. The dimple has a substantially flat, ramp-like forward surface.

In another form thereof, the invention provides an electrical connector for connecting a conductor to a generally cylindrical conductive terminal post, with a first connector portion having an open-ended cylindrical shell with an opening disposed therein. A band surrounds at least a portion of the shell, and has an inwardly extending dimple received in the opening. The dimple is of pyramid shape.

In a further form thereof, the invention provides an electrical connector for engaging a spark plug terminal post, to connect the terminal post to an electrical conductor. The connector includes a cylindrical shell for surrounding the terminal post. The shell has an open forward end and an inner surface. A dimple projects inwardly of the shell inner surface, and has a ramp-like forward surface.

An advantage of the present invention is providing a connector for a terminal post requiring less force for engaging the connector with the terminal post.

Another advantage is providing a connector for electrically connecting a conductor to a spark plug that requires less force for attaching while maintaining adequate connection after attachment.

BRIEF DESCRIPTION OF THE DRAWINGS

The above-mentioned and other features and advantages of this invention, and the manner of attaining them, will become more apparent and the invention will be better understood by reference to the following description of an embodiment of the invention, taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
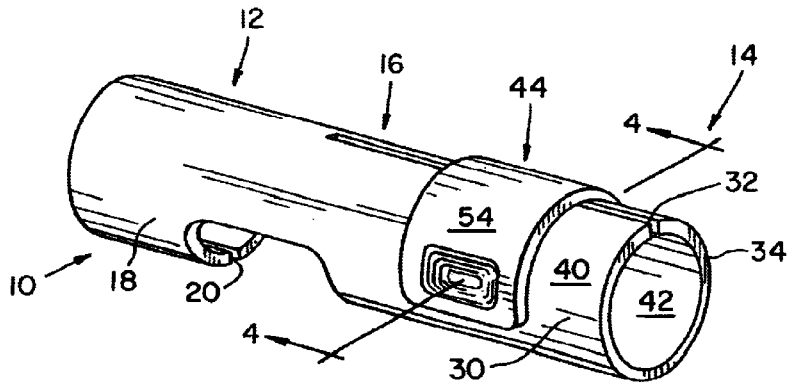
FIG. 1 is a perspective view of the electrical terminal post connector of the present invention.
Figure 2:
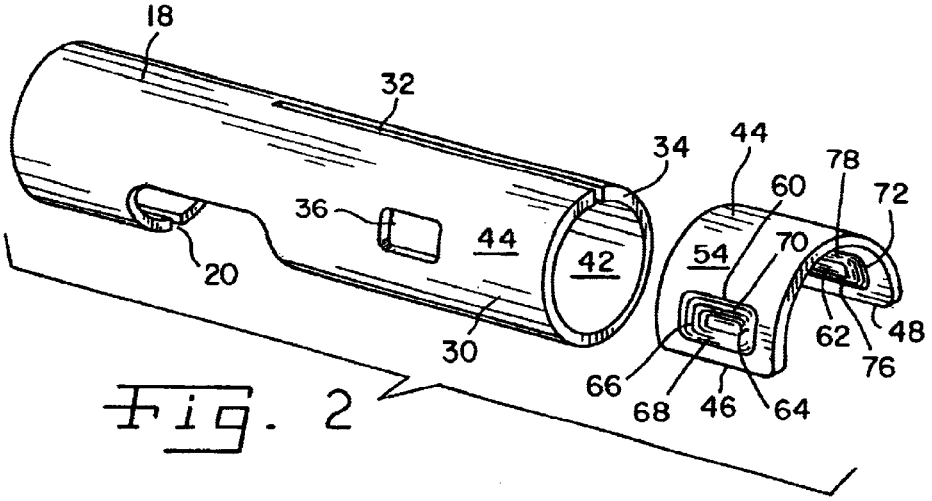
FIG. 2 is an exploded view of the connector shown in FIG. 1.
Figure 3:
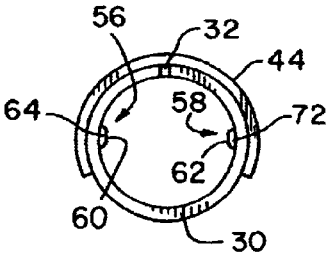
FIG. 3 is an end view of the assembled connector.
Figure 4:
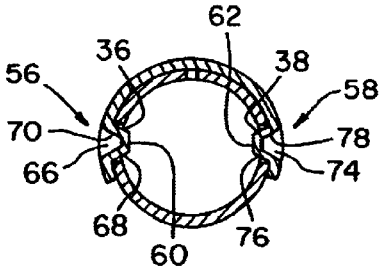
FIG. 4 is a cross-sectional view of the connector, taken on line 4—4 of FIG. 1.

Referring now to the drawings, and more particularly to FIG. 1, there is shown a spark plug terminal post connector 10 of the present invention, for connecting an insulated conductor (not shown) to a generally cylindrical conductive terminal post (not shown) of, for example, a spark plug. The connector 10 includes a wire-gripping portion 12, and a spark-plug terminal-gripping portion 14, each being generally cylindrical in shape, with a bridge portion 16 of connector 10 interconnecting wire-gripping portion 12 and spark-plug terminal-gripping portion 14. Connector 10 is formed of electrically conductive material, such as metal.

Wire-gripping portion 12 is configured for gripping the conductor (not shown), and making electrical contact with the conductor. Wire-gripping portion 12 may be configured for gripping and establishing electrical contact with a uninsulated portion of the conductor, or wire-gripping portion 12 may be configured with insulation piercing elements (not shown) for piercing the insulation of the conductor, and establishing electrical contact therewith. Wire-gripping portion 12 is a generally cylindrical tube 18, and may include a slit 20 for accommodating expansion of cylindrical tube 18 outwardly to facilitate insertion of the conductor, and inward compression of cylindrical tube 18 to crimp wire-gripping portion 12 onto the conductor.

Spark plug terminal-gripping portion 14 is provided at the opposite end of connector 10 from wire-gripping portion 12, and includes an open-ended cylindrical shell 30, of about the same axial length as the terminal post (not shown). Shell 30 has an inner circumference sized to snugly completely encircle the terminal post. Shell 30 has a longitudinal slit 32 extending inwardly from a forward end 34 of shell 30. Two holes or openings 36 and 38 are formed in shell 30, on opposite sides of slit 32. Openings 36 and 38 are generally rectangular shaped openings spaced inwardly from forward end 34, and substantially parallel to slit 32, and extend from an outer surface 40 of shell 30 to an inner surface 42.

A retention band 44 is provided for securing shell 30 on a spark plug terminal post. Band 44 is a semi-cylindrical body having ends 46 and 48, an inner surface 52 and an outer surface 54. A pair of inwardly projecting dimples 56 and 58 are provided nears ends 46 and 48, respectively. When installed on shell 30, band 44 spans slit 32, with dimples 56 and 58 extending inwardly through openings 36 and 38, respectively. Band 44 is of a size to provide inward compression of shell 30 with a spark plug terminal post inserted therein, so that dimples 56 and 58 securely engage the spark plug terminal post.

In accordance with the present invention, dimples 56 and 58 are formed inwardly from the outside of band 44, such as by punching or pressing outer surface 54. Thus, as shown, dimples 56 and 58 comprise a depression in outer surface 54 and a projection on inner surface 52. Dimples 56 and 58 are slightly smaller rectangles than are openings 36 and 38, so as to project therethrough and engage the spark plug terminal post.

Dimples 56 and 58 are substantially pyramid-shaped, or truncated pyramid-shaped, each having four walls sloping from the non-deformed areas of band 44 immediately surrounding dimples 56 and 58 to and terminating at apex segments, 60 and 62, respectively. Thus, dimple 56 includes a forward wall 64, a rearward wall 66, an outer wall 68 nearest end 46 and an inner wall 70. Dimple 58 includes a forward wall 72, a rearward wall 74, an outer wall 76 nearest end 48 and an inner wall 78.

Dimples 56 and 58 can be viewed as having a length in the axial direction of shell 30, and a width in the circumferential direction of shell 30. Dimples 56 and 58 are shown as generally elongated pyramids, with outer walls 68 and 76 and inner walls 70 and 78 being longer than forward walls 64 and 72 and rearward walls 66 and 74. When so shaped, apex segments 60 and 62 have an axial length greater than the width of each. Dimples 56 and 58 also can be more square in shape, with the walls thereof being of substantially equal length. Whether of the more elongated shape or of the more square shape, walls 64–70 and 72–78 thereof, and particularly forward walls 64 and 72, are substantially planar, ramp-like surfaces terminating at apex segments 60 and 62, respectively. The lengths of dimples 56 and 58, for expected applications of the present invention, may be of a similar dimension to the diameter of the hemispherical dimples known in the prior art. The widths of dimples 56 and 58 for, anticipated uses of the present invention, are the same or less than the diameter of the prior hemispherical dimples.

To further reduce the insertion force required for engaging connector 10 on a spark plug terminal post, dimples 56 and 58 can be coated with a low-friction coating. To reduce insertion force required without reducing the removal force necessary to dislodge connector 10 from the spark plug terminal post, forward walls 64 and 72 can be coated, while rearward walls 66 and 74 are not coated. Alternatively, more of dimples 56 and 58 can be coated, selectively, with portions of the inner surface 42 of shell 30. For manufacturing simplicity, it may be advantageous to coat all, or substantially all surfaces of band 44 and/or shell 30. A suitable low-friction coating is TENSION 2000, available from Galv-Plating of Sidney, Ohio.

In the use of spark plug terminal connector 10 of the present invention, wire-gripping portion 12 is securely connected to a conductor (not shown). Band 44 is provided fitted around shell 30, with inner surface 52 of band 44 in substantial contact with outer surface 40 of shell 30. Dimples 56 and 58 are disposed in openings 36 and 38, respectively, with apex segments 60 and 62 thereof projecting inwardly slightly beyond inner surface 42 of shell 30. As those skilled in the art will understand readily, an assembled connector 10 as thus described commonly is covered with an electrically insulating boot (not shown) having an opening substantially in alignment with open forward end 34 of shell 30.

To secure connector 10 to a spark plug, the connector is placed over the spark plug terminal post, with the post disposed in shell 30, and axial pressure is applied on connector 10 to force the connector onto the terminal post. As dimples 56 and 58 encounter the end of the terminal post, band 44 is caused to spread outwardly between ends 46 and 48. The ramp-like planar surfaces of forward walls 64 and 72 provide a smooth sliding surface past which the terminal post progresses. Dimples 56 and 58 are of a length such that the portions thereof exposed within the interior of shell 30 seat firmly in the annular groove commonly found near the end of spark plug terminal posts. With dimples 56 and 58 seated in the annular groove, the connection of connector 10 to the spark plug is complete.

It has been observed that the force required to force dimples 56 and 58 past the end of the spark plug terminal post, and into the annular groove provided on the post, is noticeably less with the ramp-like surface of the present invention, as compared to the hemispherical dimples used previously. Use of a low-friction coating on some or all surfaces of connector 10 that contact the terminal post provides a further reduction in the force required to seat the connector on the terminal post.

Dimples of the present design can be used advantageously in connector structures other than those using a band as shown and described previously herein. For example, ramp-like dimples of the present invention will work equally well with spring-like shells having dimples formed integrally therewith. Further, while two dimples have been shown and described, those skilled in the art will understand readily that, in some connectors, one dimple may be adequate, and in other connectors three or more dimples can be used. Although the electrical connector of the present invention has been described above in association with a spark plug, it should be appreciated that the electrical connector has other uses, such as at the distributor or coil end of an electrical conductor. While a straight connector has been shown, the connector also can be of the orthogonal variety described previously.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical connector for connecting a conductor to a generally cylindrical conductive terminal post, comprising:

a first connector portion comprising a cylindrical shell of about the same axial length as the terminal post, said shell having an open forward end and an inner surface with an inner circumference to completely encircle the terminal post, said shell having at least one rectangular opening therein;

a band for encircling at least a portion of said shell, said band including at least one inwardly extending dimple shaped for receipt in said at least one opening, said dimple having a forward wall, a rearward wall spaced from said forward wall and outer and inner walls between said forward and rearward walls, each said wall sloping inwardly in said band to form said dimple, said dimple having a length between said forward and rearward walls in an axial direction of said band and a width between said inner and outer walls in a circumferential direction of said band, said length being greater than said width; and a second connector portion for gripping and making electrical contact with the conductor.

2. The connector of claim 1, further comprising a pair of said openings in said shell, and a pair of said dimples in said band, each said dimple projecting through a different one of said openings.

3. The connector of claim 2, including a slit in said shell extending axially from said open forward end.

4. The connector of claim 3, said band spanning said slit from one side thereof to the other side thereof.

5. The connector of claim 4, one opening of said pair of openings disposed on one side of said slit and the other opening of said pair of openings disposed on the other side of said slit.

6. The connector of claim 4, including a low-friction coating on said inner surface of said shell.

7. The connector of claim 4, including a low-friction coating on said dimples.

8. The connector of claim 1, including a slit in said shell extending axially from said open end.

9. The connector of claim 8, said band spanning said slit.

10. An electrical connector for connecting a conductor to a generally cylindrical conductive terminal post, comprising:

a first connector portion comprising an open-ended cylindrical shell having an opening disposed therein; and a band surrounding at least a portion of said shell, said band having an inwardly extending dimple received in said opening, said dimple having a forward wall, a rearward wall spaced from said forward wall and outer and inner walls between said forward and rearward walls, each said wall sloping inwardly in said band to form said dimple, said dimple having a length between said forward and rearward walls in an axial direction of said band and a width between said inner and outer walls in a circumferential direction of said band, said length being greater than said width.

11. The connector of claim 10, further comprising a pair of said openings in said shell, and a pair of said dimples in said band, each said dimple projecting through a different one of said openings, each said dimple having a forward wall, a rearward wall spaced from said forward wall and outer and inner walls between said forward and rearward walls, each said wall sloping inwardly in said band to form said dimple, said dimple having a length between said forward and rearward walls in an axial direction of said band and a width between said inner and outer walls in a circumferential direction of said band, said length being greater than said width.

12. The connector of claim 11, said dimples having a coating of low-friction material.

13. An electrical connector for engaging a spark plug terminal post to connect the terminal post to an electrical conductor, said connector comprising:

a cylindrical shell for surrounding the terminal post, said shell having an open forward end and an inner surface; and a dimple projecting inwardly of said shell inner surface, said dimple having a forward wall, a rearward wall spaced from said forward wall and outer and inner walls between said forward and rearward walls, each said wall sloping inwardly to form said dimple, said dimple having a length between said forward and rearward walls in an axial direction of said shell and a width between said inner and outer walls in a circumferential direction of said shell, with said length being greater than said width.

14. The electrical connector of claim 13, said shell having an opening therethrough from an outer surface thereof to said inner surface, and said dimple being provided on a band at least partially surrounding said shell.

15. The connector of claim 13 including a plurality of said dimples projecting inwardly of said shell inner surface, each dimple of said plurality of dimples having a ramp-like forward surface.

* * * * *